US005322247A

United States Patent [19]

Munday et al.

[11] Patent Number: 5,322,247

[45] Date of Patent: Jun. 21, 1994

[54] QUAD-LINE KITE

[76] Inventors: J. Merrick Munday; T. Reese Munday, both of 16 Steven Rd., Kendall Park, N.J. 08824

[21] Appl. No.: 18,195

[22] Filed: Feb. 16, 1993

[51] Int. Cl.[5] ..... B64C 31/06

[52] U.S. Cl. ..... 244/153 R; 244/155 A

[58] Field of Search ..... 244/153 R, 155 A

[56] References Cited

U.S. PATENT DOCUMENTS

| | | | |
|---|---|---|---|
| 3,892,375 | 7/1975 | Dunford | 244/153 R |
| 3,894,704 | 7/1975 | Vincent | 244/153 R |
| 4,892,272 | 1/1990 | Hadzicki | 244/153 R |

FOREIGN PATENT DOCUMENTS

| | | | |
|---|---|---|---|
| 0401814 | 12/1990 | European Pat. Off. | 244/153 R |
| 415966 | 10/1910 | France | 244/153 R |
| 911223 | 7/1946 | France | 244/153 R |

*Primary Examiner*—Michael S. Huppert
*Assistant Examiner*—Anne E. Bidwell

[57] ABSTRACT

A quad-line kite having a sail shape consisting of a center rectangle or square and two outside pentagonal sections, one horizontal and at least two vertical spars, three strips of vent screen along the spars, and four control lines each attached to one quadrant of the kite, such that the kite can be flown at virtually equal speed in any direction or rotated about its axis in either direction, due to the unique balance of sail warping and air spilling capability, and also having a high sail area to weight ratio, enabling it to be flown in light as well as strong winds.

25 Claims, 5 Drawing Sheets 13
20
21
7
24
12
14
65
9
61
61
66
26
30
19
27
71
4
10
63
5
18
28
25
29
70

60
8
60
11
67
15
64
23
6
17
22
69
1
68

QUAD-LINE KITE

This invention relates to an improved kite-like flying device capable of being flown in any direction by means of four lines attached thereto.

BACKGROUND OF THE INVENTION

In recent years significant advances have been made in controllable flight kite and related airfoil technology, beginning in the 1940's with two-line kites that allowed for the first time a significant degree of flight control, and culminating within the last few years in four-line, or quad-line, kites that permit precision flying. This invention relates to an improved quad-line kite with exceptional balance of control, maneuverability at roughly equivalent speed in any direction, rotation about its axis in either direction, and flight capability in especially light winds.

Early development of kite control can be traced to Paul Garber, who in 1944 developed the Navy Target Kite (U.S. Pat. No. 2,388,478) which was maneuvered via two lines. This kite was flown from shipboard to serve as a gunnery target. A variety of two line kites for recreational use followed, represented in popular versions by the Peter Powell (U.S. Pat. Nos. 3,954,235 and 4,076,189), a two-line kite shaped like a traditional diamond kite, and the Flexifoil (U.S. Pat. No. 4,129,272), a two-line kite shaped like an aerofoil and inflated by wind pressure from the front.

In the most recent development, a number of four-line, or quad-line, kites have been marketed. These kites in general exhibit a remarkable degree of precision flying and control by means of the four control lines. Typical examples of these quad-line kites that are available include models with names such as "Revolution" (U.S. Pat. No. 4,892,272), "Omni" (Stunt Kite Quarterly Magazine, back cover, Fall/Winter 1991), and "Tetrad" (American Kite Magazine, p.45, Summer 1991). All are significant advancements over two-line kites in terms of their ability to be rotated or flown in various directions at the operator's command via the four lines.

The available quad-line kites, while substantially advanced over the prior art of two-line kites, nevertheless do have limitations. These limitations generally relate to the ability of the kite to move in various directions. For this purpose, it is helpful to understand that the edge of the kite connected to lines attached to the upper ends of the control handles (as they are held by the operator) is generally considered to be the "front" of the kite. Therefore, when the kite in question is moving in the direction of that edge, it can be said to be moving "forward". Movement in the opposite direction of that edge is generally termed "reverse."

The Revolution is advertised by its manufacturers as being capable of "forward and reverse flight." No mention is made of the possibility of sideways flight. Experienced operators are able to cause the kite to fly directly sideways, but this maneuver is not achievable by non-experts. However, even in the hands of an expert, the rate of sideways flight is markedly slower than the rate of forward flight. Also, it is difficult to maintain the Revolution in motion once sideways flight has begun. In addition, the rate of reverse flight is much slower than the rate of forward flight. Thus, the Revolution falls short of the ideal kite which would have the ability to fly with stability in all directions at equal speed.

To address this problem, two other manufacturers have devised quad-line kites. The Tetrad is advertised to provide flight "in all directions." In this respect its manufacturer has succeeded. The Tetrad is maneuverable in all directions by quad-line operators of average ability. However, the rates of sideways and forward-/reverse flight are not equal, and the kite is unacceptably slow in all directions. The Tetrad is also difficult to accelerate smoothly from a hovering position into flight in a given direction. Additionally, it is difficult to cause the Tetrad to continue moving with stability in any direction once movement has begun.

The Omni also advertises "performance in all directions." Like the Tetrad, the Omni is maneuverable in all directions by operators of average ability. Also like the Tetrad, the Omni exhibits a resistance to beginning motion in a given direction. The Omni is capable of stable sideways motion, but forward and reverse flight are difficult to maintain. Most importantly, however, the Omni's rates of movement are not equal. In contrast with the Revolution, which moves fastest in a forward direction, the Omni is much faster in the sideways direction than in forward or reverse.

In all of the above cases, there is an instability in motion or a resistance to motion that is manifested by the kite twisting slightly and moving in a direction other than the desired one. Another universal problem is the excessive weight of the spars relative to the sail area of the kite. This hinders the ability of the kites to fly in low wind. Finally, each of the above kites has a limitation in its ability to move as quickly in one direction as it can in others. Therefore, in summary, the available quad-line kites 1) do not exhibit the desired ability to easily begin and maintain flight in all directions, 2) do not exhibit the desired ability to fly in low wind, and 3) do not exhibit the desired ability to move with equal speed in any direction.

SUMMARY OF THE INVENTION

The present invention comprises a kite having a sail that has a center portion, the center portion separating a right and a left polygon shape, supported by one horizontal spar extending the breadth of the kite and two vertical spars extending to the vertical tips of the two polygon shapes, and controlled by four lines. Other features of the invention include the use of screen or air-passing material in the sail in proximity to horizontal and/or vertical spars, spars located on either side of the sail, and a four control line bridle connected to points on the horizontal spar and the vertical spars. This kite overcomes the limitations of available quad-line kites. It provides quick response to commands via the control lines, moves in any direction with approximately equal speed, can fly in light winds, and is easy to learn to fly.

DESCRIPTION OF THE PREFERRED EMBODIMENT

Figure 1:
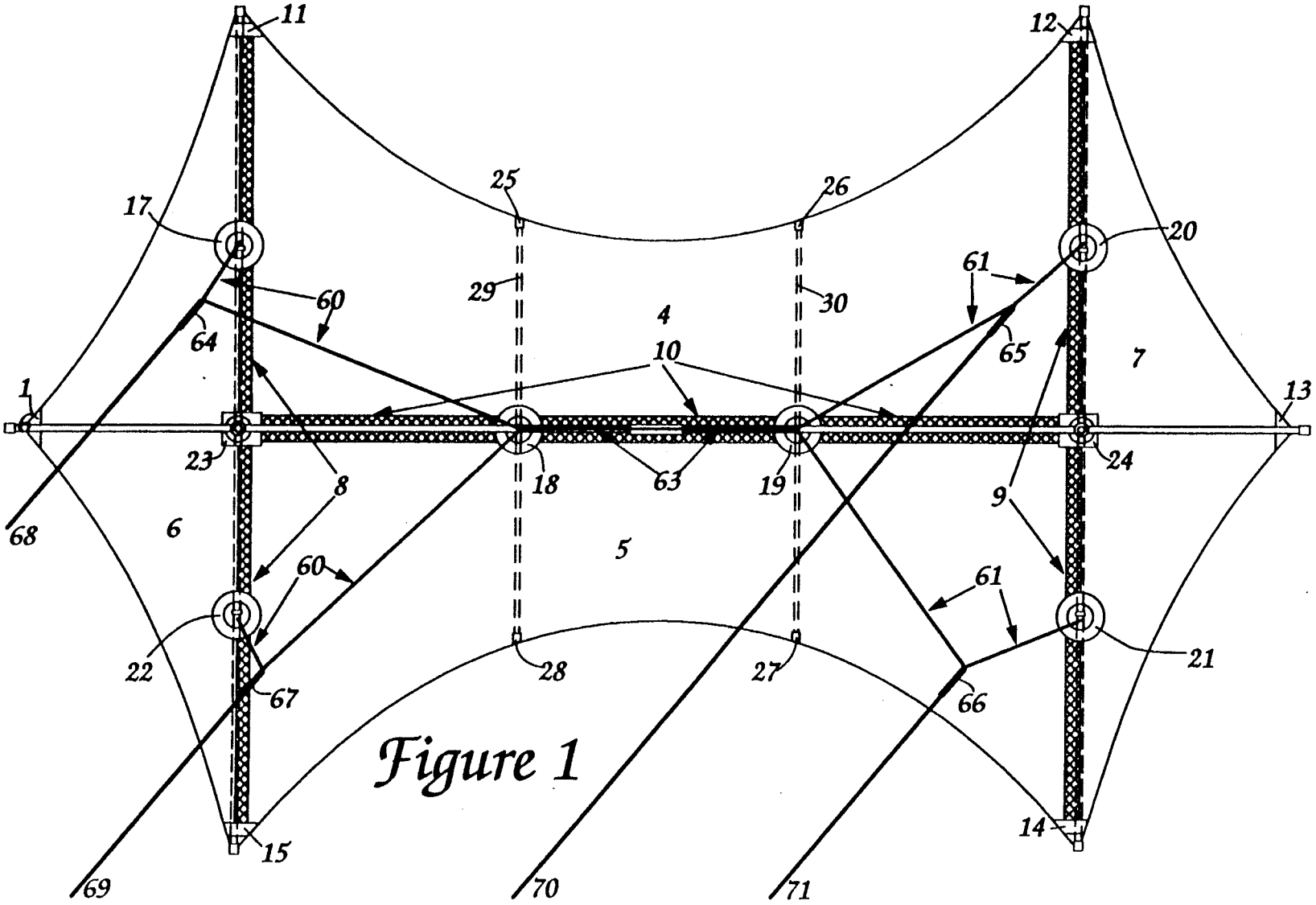
FIG. 1 shows an assembled embodiment of the invention.

As shown in FIG. 1, the sail can be constructed of any light, flexible, nonporous, fabric-like material. Ripstop Nylon has been found to be especially suitable for this purpose. The sail is made by assembling four separate sections of this material, being an upper 4 and a lower 5 center sail section, and a left 6 and a right 7 sail section. These sections are then connected to each other by three strips of venting screen 8, 9, and 10. These connections, as well as the rest of the assembly of the sail, are usually made by sewing, but it is obvious that they could be attached with adhesives or other suitable methods. The venting screen can be any suitable material that is flexible, that can be attached to the sail material, and that permits the passage of air. A preferred material is known as "tent netting," and is used for screen doors on tents.

The six tips of the sail are provided with reinforcements of Dacron sailcloth 11, 12, 13, 14, 15, and 16, through which holes are provided for the connection of the tips of the sail to the ends of the frame spars.

The sail contains six holes for the attachment of the bridle to the frame, which are provided with circular Dacron sailcloth reinforcements 17, 18, 19, 20, 21, and 22. Reinforcements 23 and 24 are also provided around two other holes, which are provided for the connection of any frame spars located in front of the sail to any frame spars located behind the sail. Reinforcements 17 through 24 act to strengthen the attachment of the sections of sail fabric to the venting screen and to each other.

At the upper and lower central edges of the sail, four small elongated pockets 25, 26, 27, and 28 are provided for the insertion of the ends of the auxiliary spars 29 and 30. These four small pockets can also be made of Dacron sailcloth. Auxiliary spars 29 and 30 are usually placed behind the sail and extend from the bottom to the top of the right and left hand vertical edges of the center rectangle.

In order to connect the four control lines 68, 69, 70, and 71 to the kite in the optimal locations, a bridle is normally used to distribute the line tension to the frame of the kite. The bridle is formed from two identical sections of line, which correspond to the left and right halves of the kite. Each section contains a main bridle line 60 or 61, and two quick-connect lines 64 and 67, or 65 and 66. The ends of main bridle line 60 are attached to the frame through reinforcements 17 and 22. It has been found appropriate to locate reinforcements 17 and 22 at sites between the ends and the midpoint of the vertical spar. A preferred location was found to be approximately one quarter of the spar length from each end of the vertical spar. This location provides a balanced application of tension from the control lines to the vertical spars, allows the minimum bowing of the spars during flight of the kite, and minimizes the breakage of vertical spars. The center of main bridle line 60 attaches through reinforcement 18 to the auxiliary spar 29. Again, attachment of the center of bridle line 60 at this point at the edge of the center rectangle has been found to provide a balanced application of tension from the control lines to the horizontal spar during flight, so that minimum bowing of the horizontal spar occurs, and reduced breakage of the that spar occurs. Other attachment sites between the midpoint of the horizontal spar and attachment 23 could also be used for the attachment of the midpoint of the left-hand bridle.

Quick-connect lines 64 and 67 are positioned on main bridle line 60, providing convenient attachment points for two of the four control lines. Main bridle line 61 is similarly attached through reinforcements 19, 20, and 21 to auxiliary spar 30 and to the frame, with quick connect lines 65 and 66 positioned on it. Center line 63 is attached to the center of main bridle line 60 at one end and to the center of main bridle line 61 at the other, where they attach to auxiliary spars 29 and 30 respectively. Center line 63 prevents the center attachment of main bridle lines 60 and 61, and therefore auxiliary spars 29 and 30, from moving outward during flight. Although the bridle apparatus has been described as utilizing two main bridle lines, four quick connect lines, and one center line, it is obvious that each of these could be made from shorter lengths of line tied together. Also, it is obvious that the whole bridle could be made from only one line by appropriately knotting it.

The control lines 68, 69, 70, and 71 are attached to handles (not shown) to allow the operator to manipulate them effectively. In conventional practice, the upper left and lower left lines 68 and 69 would be attached respectively to the top and bottom of a left handle, and the upper right and lower right lines 70 and 71 would be attached to the top and bottom of a right handle. The handles may be straight or curved. It has been found that individual operators have different preferences for the curvature and length of the handles, based on their personal style of operating the kite. This use of a pair of elongated control handles to control a quad-line kite, with each handle controlling two lines, is well known in the art.

Figure 2:
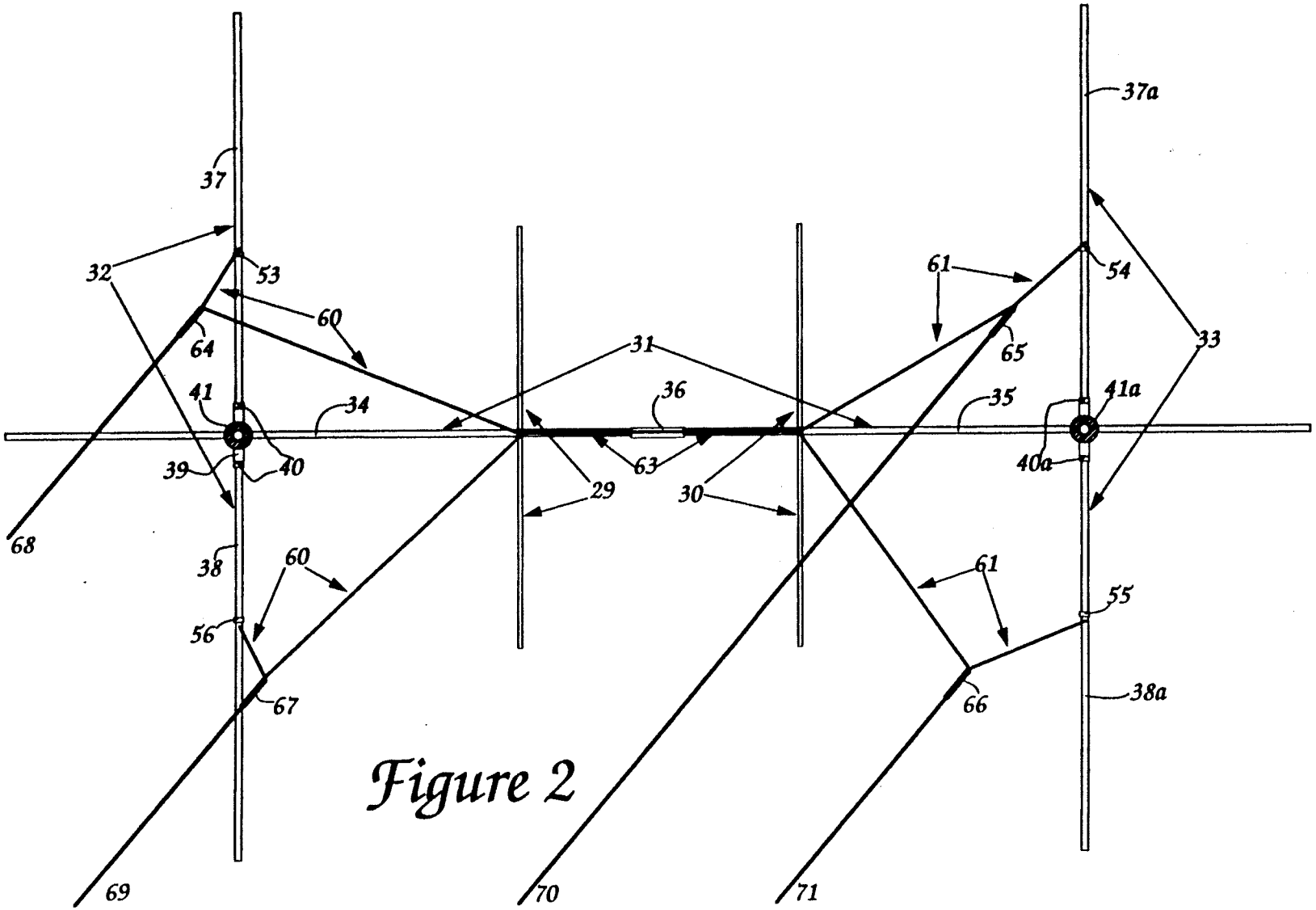
FIG. 2 shows the frame assembly and the bridle assembly used to attach the control lines to the frame for one embodiment of the invention.

As shown in FIG. 2, the frame consists of a horizontal spar 31, two vertical spars 32 and 33, and two auxiliary vertical spars 29 and 30. The horizontal spar 31 may be formed of two members 34 and 35 made of carbon fiber graphite composites, and joined with a sleeve of ferrule 36 made of aluminum tubing or other similar lightweight material. The ferrule can be epoxied or otherwise attached to one of the members, such that members 34 and 35 remain free to twist on their longitudinal axis relative to each other. This twisting action is desirable to achieve the optimum performance of the kite.

It will be appreciated by those skilled in the art that there are a limited number of lengths of carbon fiber tubes commonly available. This may necessitate the use of joints in the frame, especially when the kite is made in larger sizes. In the event that carbon fiber members are not available in sufficient length to form vertical spars 32 and 33 of single pieces, they may each be formed of two carbon fiber lengths in a manner similar to that described above for horizontal spar 31. For example, members 37 and 38 can be inserted into and joined by aluminum tubing 39 to form spar 32. Members 37*a* and 38*a* can be similarly joined to form spar 33. The members can also be provided with "shoulders" 40, made from short sections of vinyl tubing glued to the outside of the carbon fiber members 37 and 38, and located so that each member, when inserted to its shoulder, may penetrate only one-half the length of the aluminum tubing 39. This method of construction also permits easy disassembly of the vertical spars, should that be desired.

The frame is further provided with shoulders 53, 54, 55, and 56 made of vinyl tubing glued at the four attachment points of the bridle. These shoulders serve to prevent the bridle from sliding together on the frame.

Figure 3:
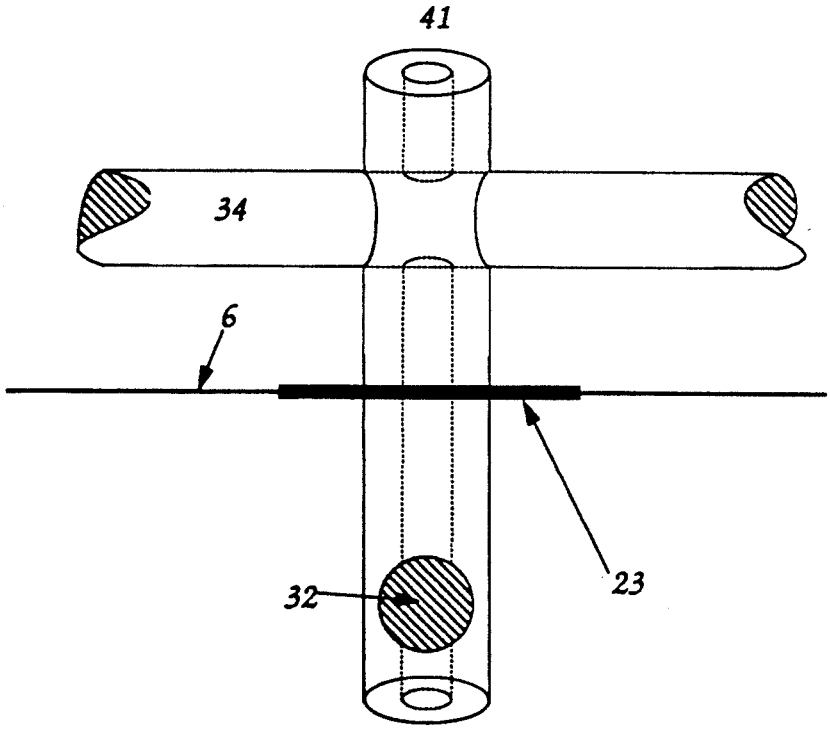
FIG. 3 is a bottom view section detailing the connection between the horizontal spar and one of the two vertical spars for an embodiment of the invention.

Although it has been found advantageous to locate horizontal spar 31 in front of the sail and vertical spars 32 and 33 behind the sail (as illustrated in FIG. 1), the kite will fly well with any combination of spars in front of or behind the sail. FIG. 3 is a bottom view section of the kite showing the connection of vertical spar 32 to the left end 34 of horizontal spar 31 in a way that locates the vertical spar behind the sail and the horizontal spar in front of the sail. This connection is made using a short section of vinyl tubing 41 which is provided with two holes at right angles to each other. These holes are of slightly smaller diameter than the spars, so that the vinyl tubing must stretch slightly as it is fitted over the spars. This keeps the vinyl tubing from sliding on the spars. The vertical spar 32 is inserted through the vinyl tubing 41 so that the vinyl is located at the center of vertical spar 32. The vinyl tubing is then inserted from the back of the sail through reinforcement 23 to the front of the sail. Finally, horizontal spar 34 is inserted across the front of the kite into the second hole in vinyl tubing 41. In a similar manner, vertical spar 33, vinyl tubing 41*a*, reinforcement 24, and right end 35 of horizontal spar 31 are assembled at the other end of the kite.

Figure 4:
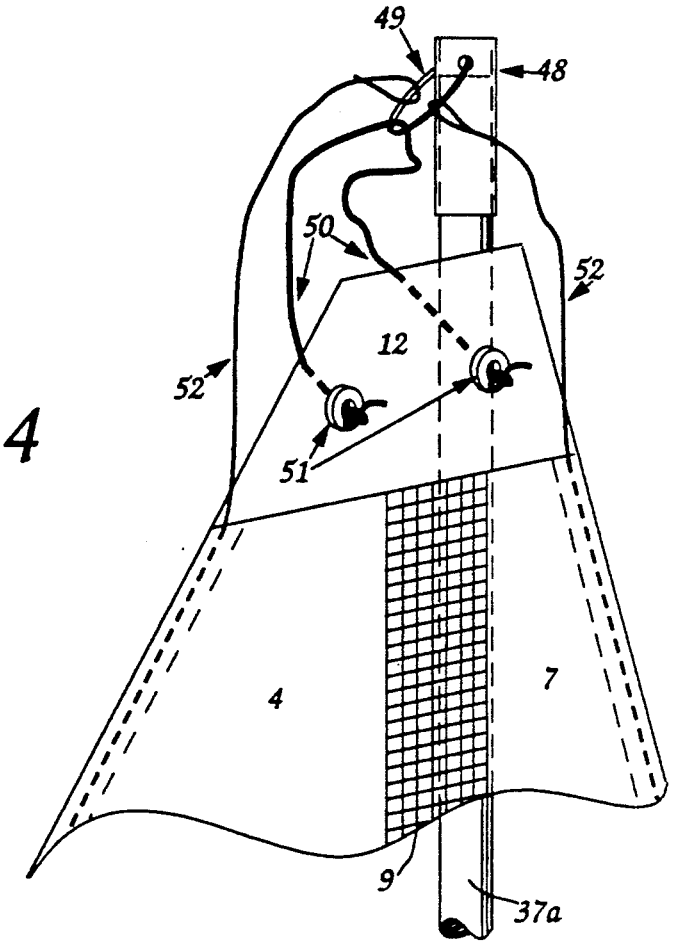
FIG. 4 is a detail of the area at one of the tips of the sail, showing a method for attaching the sail to the frame for one embodiment of the invention.

FIG. 4 shows how the six outer ends of the assembled frame can be attached to sail reinforcements 11, 12, 13, 14, 15, and 16. Each frame end can be provided with a short length of plastic tubing 48 having a small hole in its end. A small split ring 49 is passed through this hole, and a short section of elastic shock cord 50 is inserted through the ring. The cord is then passed through small holes in the reinforcement 11, 12, 13, 14, 15, or 16, and on through a short section of small-diameter vinyl tubing 51, after which it is knotted. This apparatus is well known in the art. The outer edges of all four sail portions are sewn so that pocket hems are formed through which a thin tensioning line 52 of Dacron TM may be passed. The aforementioned split rings provide attachment points for these tensioning lines 52.

Figure 5:
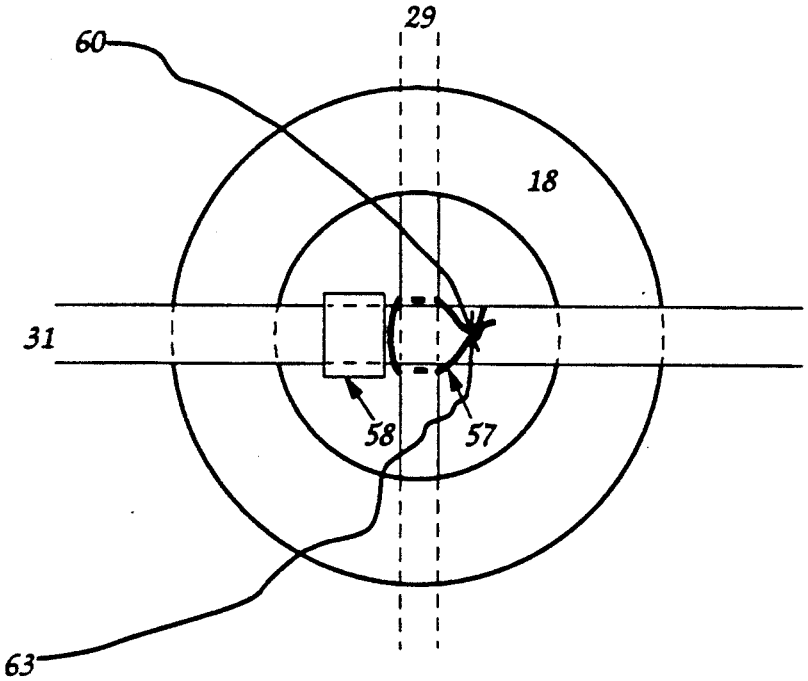
FIG. 5 is a detail of the connection between the horizontal spar and an auxiliary vertical spar, also showing the connection of the bridle, for one embodiment of the invention.

The auxiliary vertical spars 29 and 30 are each formed of a single carbon fiber member of considerably smaller diameter than the rest of the frame. The auxiliary vertical spars usually extend behind the sail from the bottom to the top of the sail at the locations shown in FIGS. 1 and 2. As shown in FIG. 5, auxiliary vertical spar 29 is linked to the horizontal spar 31 by a short loop tied in the center of main bridle line 60, which also provides an attachment point for center line 63. Auxiliary vertical spar 30, main bridle line 61, the other end of center line 63, and horizontal spar 31 on the right half of the kite are connected in the same manner.

Figure 6:
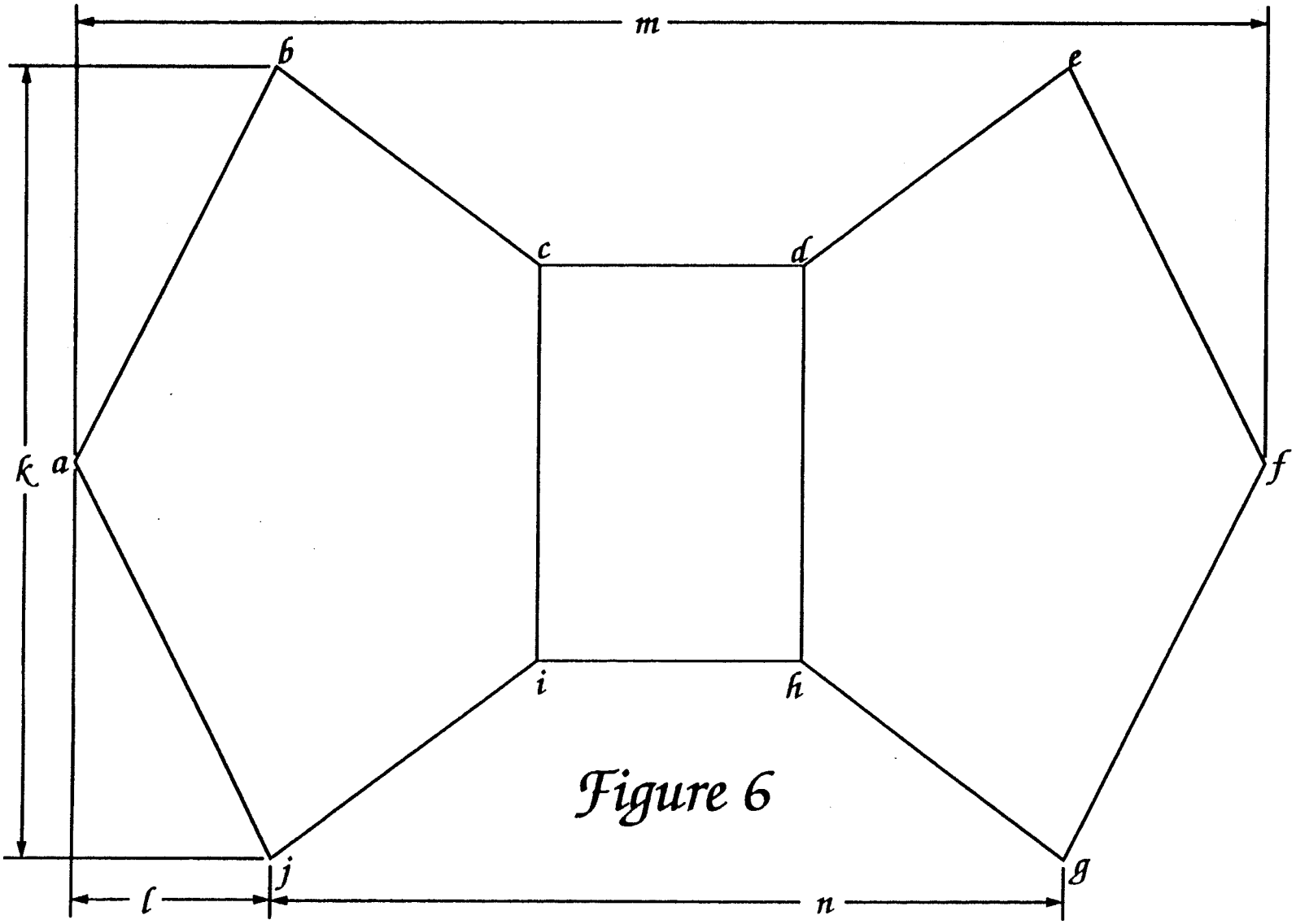
FIG. 6 is a plan view of the sail shape in its basic form, without the curves present in the embodiment of the invention shown in FIG. 1.

FIG. 6 is a plan view of the sail shape in its basic form, without the curved sail edges. Area cdhi is a center portion, preferably a rectangle, whose longer sides can be horizontal as well as vertical, or it can be a square. Areas abcij and defgh are two polygonal, and preferably pentagonal, sail areas which share common boundaries along sides ci and dh with the center rectangle. The relation of the height of the center rectangle (length ci or dh) to the height of the two pentagons k is important to achieve the optimum balance of two factors: 1) the maximum warping of the kite sail during control which allows the greatest maneuverability and 2) the maximum sail area per spar weight and overall kite weight to allow the kite to interact with the most air during flight and consequently to fly in the lightest wind. A good balance of these factors that has been found is to have the heights ci and dh of the center rectangle be in the range of $\frac{1}{4}$ to $\frac{3}{4}$ the overall height of the kite k, with the optimum approximately $\frac{1}{2}$ the height k.

In determining the optimum width for the center rectangle (length cd or hi), the same considerations apply. Reducing the width yields a shape with more sail area and less flexibility, while increasing the width decreases total sail area while increasing the warping flexibility. A center rectangle whose width is from $\frac{1}{2}$ to $1\frac{1}{2}$ times its height, with the optimum being approximately $\frac{2}{3}$ the height, has been found to work well.

The length l of the sail pentagons that lie outside the vertical spars must be sufficient to provide side-to-side flying stability, but there is no particular limiting size. A distance between the vertical spars of about $\frac{1}{2}$ to $\frac{3}{4}$ of the total horizontal length of the kite has been found to give satisfactory performance. It has been found that having approximately $\frac{2}{3}$ the total horizontal width of the kite inside the vertical spars, and therefore 1/6 of that width outside the spars at each end, results in good performance. By testing, it is substantially clear that kite stability at sharp angles to the wind is diminished by not having these end sections of the sail.

The ratio of the overall dimensions of the sail, m to k, can vary from 1-to-1 up to 2-to-1, with the preferred ratio being about $1\frac{1}{2}$-to-1.

To improve the simple design shown in FIG. 6, a number of alterations may be made. In order to control the sail more accurately in flight, two auxiliary spars 29 and 30 may be positioned along the vertical sides of the center rectangle. These spars will have the effect of stiffening the sail in this area, causing the flight to be more controlled. Tensioning lines may be run along the edges of the sail in pocket hems, and the edges of the sail may be curved, rather than straight. Both of these sail-edge improvements act to reduce vibration of the edges and turbulence caused by that vibration. This causes the kite to be more controllable in flight, and to move with greater speed.

The performance of the kite can also be improved by the use of vertical and horizontal vent screens. FIG. 1 shows the preferred location of the wind venting screens. It is seen that the horizontal vent screen best extends on both sides of the horizontal spar, while the vertical screens are located only on the inside of the vertical spars, and are therefore typically only half as wide. Screen widths less than about $\frac{3}{8}$ of an inch will not provide sufficient air venting capability, while widths greater than about 3 inches will begin to reduce the sail area without added benefit.

It is important to understand that the control of the kite direction and speed of movement is dependent on air motion past one or another sail area. In the present design therefore, the vertical screens provide opportunity for the air trapped by the sail to flow out through the screen ahead of the vertical spars, which allows excellent horizontal movement of the kite in either direction.

It is recognized that the airflow across separate parts of the venting screens occurs in differing volumes. From this, it is obvious that the required area of venting screen to allow the typical airflow to pass through the kite is also different. Therefore, it is probable that varying the width of the vent screens along their length would result in an increase in performance. Such optimization would also probably decrease the weight of the kite (since venting screen normally weighs more than sail material), resulting in increased low-wind performance.

We claim:

1. A kite, comprising:

a sail, consisting of a shape having a center portion, said center portion separating a right and a left pentagonal shape with said center portion having one vertical edge in common with each pentagonal shape, and a frame, consisting of three spars, including one horizontal spar midway between the top and bottom of said sail and extending from the right end to the left end of the sail, and one vertical spar extending from the bottom end to the top end of the right pentagonal shape, and a second vertical spar extending from the bottom end to the top end of the left pentagonal shape, and control lines, each connected to the kite.

2. The kite of claim 1, wherein the center portion is substantially rectangular.

3. The kite of claim 1, wherein the maximum horizontal length of the kite is about 1 to 2 times the maximum vertical length of the kite.

4. The kite of claim 1, wherein the maximum horizontal length of the kite is about 1 and ½ times the maximum vertical length of the kite.

5. The kite of claim 1, wherein the vertical length of the center portion is about ¼ to ¾ times the vertical length of the pentagonal shapes.

6. The kite of claim 1, wherein the vertical length of the center portion is about ½ times the vertical length of the pentagonal shapes.

7. The kite of claim 1, wherein the horizontal length of the center portion is about ½ to 1 and ½ times the vertical length of the center portion.

8. The kite of claim 1, wherein the horizontal length of the center portion is about ⅔ times the vertical length of the center portion.

9. The kite of claim 3, wherein the distance between the vertical spars is about ½ to ¾ of the total horizontal length of the kite.

10. The kite of claim 1, wherein the distance between the vertical spars is about ⅔ of the total horizontal length of the kite.

11. The kite of claim 1, wherein two auxiliary spars are located along the vertical edges of the center portion.

12. The kite of claim 1, wherein four control lines are connected to two bridles, which are then connected to the kite.

13. The kite of claim 1, wherein four control lines are connected, two to each of two bridles, which bridles are then each connected to the kite at three sites: two sites on a vertical spar, and one site on the horizontal spar.

14. The kite of claim 1, wherein four control lines are connected, two to each of two bridles, being a right-hand bridle connected to the kite at three sites, with one end of said right-hand bridle connected to said right vertical spar at a site about one quarter of the length of said right vertical spar from the top end of said right vertical spar, the midpoint of said right-hand bridle connected to said horizontal spar about at the right vertical edge of said center portion, and the other end of said right-hand bridle connected to said right vertical spar at a site about one quarter of the length of said right vertical spar from the bottom end of said right vertical spar, and a left-hand bridle similarly connected to the kite at three sites, with one end of said left-hand bridle connected to said left vertical spar at a site about one quarter of the length of said left vertical spar from the top end of said left vertical spar, the midpoint of said left-hand bridle connected to said horizontal spar about at the left vertical edge of said center portion, and the other end of said left-hand bridle connected to said left vertical spar at a site about one quarter of the length of said left vertical spar from the bottom end of said left vertical spar.

15. The kite of claim 1, wherein the vertical spars are located behind the sail, and the horizontal spar is located in front of the sail.

16. The kite of claim 1, wherein the vertical spars and the horizontal spar are located behind the sail.

17. The kite of claim 1, wherein the horizontal spar is formed of at least two spar sections, joined such that the joint allows the spar sections to rotate independently of each other.

18. A kite, comprising:

a sail, consisting of a shape having a center portion, said center portion separating a right and a left pentagonal shape with said center portion having one vertical edge in common with each pentagonal shape, and a frame, consisting of three spars, including one horizontal spar midway between the top and bottom of said sail and extending from the right end to the left end of the sail, and one vertical spar extending from the bottom end to the top end of the right pentagonal shape, and a second vertical spar extending from the bottom end to the top end of the left pentagonal shape, and three strips of vent screen, one positioned in proximity to the horizontal spar and one positioned in proximity to each vertical spar, and control lines, each connected to the kite.

19. The kite of claim 18, wherein the vent screens are positioned only on the side of the vertical spars closer to the center portion.

20. The kite of claim 18, wherein the width of the vent screens is about 154 to 3 inches.

21. The kite of claim 18, wherein the width of the vent screens varies along their length.

22. A kite-like flying device comprising a sail connected to a supporting frame, said supporting frame including a horizontal spar approximately centered between the top and bottom extremities of said flying device, said sail having less surface area at the center than at its outer portions, said outer portions including a left portion and a right portion and four control line contact points connected to upper and lower areas of said left and right portions, and screen or other air-passing material in the sail essentially parallel and adjacent to said horizontal spar.

23. A kite-like flying device comprising a sail connected to a supporting frame, said supporting frame including at least two vertical spars, said sail having less surface area at the center than at its outer portions, said outer portions including a left portion and a right portion and four control line contact points connected to upper and lower areas of said left and right portions, and screen or other air-passing material in the sail essentially parallel and adjacent to each said vertical spar.

24. A kite-like flying device comprising a sail connected to a supporting frame, said sail having less surface area at the center than at its outer portions, said outer portions including a left portion and a right portion, said supporting frame including a horizontal spar approximately centered between the top and bottom extremities of said flying device, and two vertical spars, associated with said right and left portions respectively, two bridles connecting four control lines to said frame, each bridle attached at three sites, a right-hand bridle being attached first to said right vertical spar at a site between the top and center of said right vertical spar, second to said horizontal spar at a site between said right vertical spar and the center of said horizontal spar, and lastly to said right vertical spar at a site between the bottom and the center of said right vertical spar, and a similar left-hand bridle being attached first to said left vertical spar at a site between the top and center of said left vertical spar, second to said horizontal spar at a site between said left vertical spar and the center of said horizontal spar, and lastly to said left vertical spar at a site between the bottom and the center of said left vertical spar.

25. A kite, comprising:

a sail, consisting of a shape having a center rectangle, said rectangle separating a right and a left pentagonal shape with said rectangle having one vertical edge in common with each pentagonal shape, said sail having curved outer edges, said edges being formed with pockets through which tensioning means is passed to stiffen said edges of said sail, and a frame, consisting of five spars, including one horizontal spar midway between the top and bottom of said sail and extending in front of said sail from the right end to the left end of said sail, and a first vertical spar extending behind said sail from the bottom end to the top end of said right pentagonal shape, and a second vertical spar extending behind said sail from the bottom end to the top end of said left pentagonal shape, and a first auxiliary vertical spar extending behind said sail from the bottom to the top of the right vertical edge of said center rectangle, and a second auxiliary vertical spar extending behind said sail from the bottom to the top of the left vertical edge of said center rectangle, and three strips of vent screen, one positioned essentially parallel and adjacent to said horizontal spar and one positioned essentially parallel and adjacent to each of said first and second vertical spars, and four control lines, two of said lines being connected to each of two bridles, one of said bridles being connected to the left half of the kite and the other of said bridles being connected to the right half of the kite, each of said bridles being connected to said kite at three sites: two sites on said first and second vertical spars, about one quarter of the length of said first and second vertical spars from each end of said first and second vertical spars, and one site on said horizontal spar, about at the edge of said center rectangle.

* * * * *